US010309698B2

(12) United States Patent
Lv et al.

(10) Patent No.: US 10,309,698 B2
(45) Date of Patent: Jun. 4, 2019

(54) OIL RETURN MANAGEMENT IN A HVAC SYSTEM

(71) Applicants: TRANE INTERNATIONAL INC., Davidson, NC (US); TRANE AIR CONDITIONING SYSTEMS (CHINA) CO., LTD., Taicang, Jiangsu (CN)

(72) Inventors: Zhenhai Lv, Shanghai (CN); Limin Zhang, Shanghai (CN); Wenyong Chen, Shanghai (CN)

(73) Assignees: TRANE INTERNATIONAL INC., Davidson, NC (US); TRANE AIR CONDITIONING SYSTEMS (CHINA) CO., LTD., Taicang, Jiangsu (CN)

( * ) Notice: Subject to any disclaimer, the term of this patent is extended or adjusted under 35 U.S.C. 154(b) by 0 days.

(21) Appl. No.: 15/583,118

(22) Filed: May 1, 2017

(65) Prior Publication Data

US 2017/0234586 A1 Aug. 17, 2017

Related U.S. Application Data

(63) Continuation of application No. 14/888,854, filed as application No. PCT/CN2013/075105 on May 3, 2013, now Pat. No. 9,638,445.

(51) Int. Cl.
*F25B 49/02* (2006.01)
*F25B 31/00* (2006.01)

(52) U.S. Cl.
CPC ..... *F25B 31/004* (2013.01); *F25B 2400/05* (2013.01); *F25B 2600/2519* (2013.01)

(58) Field of Classification Search
CPC .... F25B 31/004; F25B 1/047; F25B 2004/05; F25B 2600/2519; F25B 49/02; F25B 31/00
See application file for complete search history.

(56) References Cited

U.S. PATENT DOCUMENTS 2,246,845 A 6/1941 Durden
4,303,090 A * 12/1981 Mayer ..... F25B 31/004 137/114

(Continued)

FOREIGN PATENT DOCUMENTS

CN 2814269 Y 9/2006
CN 101042258 9/2007

(Continued)

OTHER PUBLICATIONS

International Search Report and Written Opinion, dated Feb. 20, 2014; PCT/CN2013/075105 (8 pages).

*Primary Examiner* — Melvin Jones
(74) *Attorney, Agent, or Firm* — Hamre, Schumann, Mueller & Larson, P.C.

(57) ABSTRACT

Methods, systems, and apparatuses are described to help manage oil return such as in a chiller system of a HVAC system. A refrigerant/oil mixture can be directed out of the evaporator into an oil return heat exchanger that is configured to help vaporize a refrigerant portion of the refrigerant/oil mixture. Superheat refrigerant vapor can be directed from a condenser into the oil return heat exchanger as the heat energy to vaporize the refrigerant portion in the refrigerant/oil mixture. The oil return heat exchanger can be positioned lower than the evaporator so that gravity can help the refrigerant/oil mixture to flow into the oil return heat exchanger.

11 Claims, 2 Drawing Sheets

(56) References Cited

U.S. PATENT DOCUMENTS

| | | | | |
|---|---|---|---|---|
| 5,086,621 | A | 2/1992 | Starner et al. | |
| 5,761,914 | A | 6/1998 | Carey et al. | |
| 6,216,474 | B1 | 4/2001 | Sishtla | |
| 7,607,317 | B2 * | 10/2009 | Honda | F25B 13/00 62/160 |
| 2010/0218522 | A1 * | 9/2010 | Cochran | F25B 31/004 62/115 |
| 2012/0234037 | A1 | 9/2012 | Tadano et al. | |
| 2013/0247607 | A1 * | 9/2013 | Love | F25B 31/002 62/470 |

FOREIGN PATENT DOCUMENTS

| | | | |
|---|---|---|---|
| CN | 201306892 | Y | 9/2009 |
| CN | 201680645 | | 12/2010 |
| CN | 201748711 | | 2/2011 |
| JP | 2011149566 | A | 8/2011 |

* cited by examiner

OIL RETURN MANAGEMENT IN A HVAC SYSTEM

FIELD

The disclosure herein relates to heating, ventilation, and air-conditioning ("HVAC") systems, such as may include a chiller. Generally, methods, systems, and apparatuses are described that are directed to oil return management in the HVAC systems.

BACKGROUND

A HVAC system can typically include a compressor, heat exchangers such as a condenser and an evaporator, and an expansion device forming a refrigeration circuit. Refrigerant vapor is generally compressed by the compressor, and then condensed into liquid refrigerant in the condenser. The liquid refrigerant is then expanded by the expansion device to become low-pressure low-temperature two-phase refrigerant and is directed into the evaporator; and the two-phase refrigerant can then exchange heat with a process fluid, such as air or water, in the evaporator. The two-phase refrigerant may be vaporized in the evaporator and return to the compressor. The process fluid may then be used for other purposes, such as for example cooling a space of a building.

The compressors of the HVAC system, such as a screw compressor, may be lubricated, for example, by oil. The oil can circulate in the refrigerant circuit along with the refrigerant.

SUMMARY

Embodiments of managing oil return in a HVAC system are provided. Generally, a refrigerant/oil mixture in an evaporator can be directed out of the evaporator into an oil return heat exchanger configured to help vaporize a refrigerant portion of the refrigerant/oil mixture with heat energy. The vaporized refrigerant portion can then entrain the oil portion of the refrigerant/oil mixture to drive the oil portion back to, for example, the compressor. In some embodiments, superheat refrigerant vapor from a condenser can be directed into the oil return heat exchanger as the heat energy to vaporize the refrigerant portion in the refrigerant/oil mixture.

In some embodiments, a HVAC system may include an oil return heat exchanger that has an evaporator side configured to receive a refrigerant/oil mixture from the evaporator and a condenser side configured to receive superheat refrigerant vapor from the condenser. The evaporator side and the condenser side may be configured to exchange heat in the oil return heat exchanger.

In the evaporator side of the oil return heat exchanger, a refrigerant portion of the refrigerant/oil mixture from the evaporator may be vaporized so that an oil portion of the refrigerant/oil mixture may be entrained by the vaporized refrigerant portion. In some embodiments, the refrigerant/oil mixture flowing out of the oil return heat exchanger may be directed into the compressor by, for example, suction of the compressor.

In the condenser side of the oil return heat exchanger, the superheat refrigerant vapor may be condensed into liquid refrigerant. In some embodiments, the condensed liquid refrigerant may be directed back to the condenser after flowing out of the oil return heat exchanger.

In some embodiments, the oil return heat exchanger may be physically positioned lower than the evaporator so that gravity can help direct the refrigerant/oil mixture to the oil return heat exchanger. In some embodiments, the evaporator side of the oil return heat exchanger may have an evaporator-side inlet and an evaporator-side outlet, and the evaporator-side outlet may be positioned physically higher than the evaporator-side inlet.

In some embodiments, the condenser side of the oil return heat exchanger may have a condenser-side inlet and a condenser-side outlet, and the condenser-side outlet is positioned physically higher than the condenser-side inlet.

In some embodiments, the condenser has a condenser oil return heat exchanger outlet and a condenser oil return heat exchanger inlet, and the condenser oil return heat exchanger outlet is positioned physically higher than the condenser oil return heat exchanger inlet.

In some embodiments, the oil return heat exchanger may be a brazed-plate heat exchanger. In some embodiments, the compressor may be a screw compressor.

A method of managing oil return in a HVAC system may include directing superheat refrigerant vapor into a first side of an oil return heat exchanger, directing a refrigerant/oil mixture into a second side of the oil return heat exchanger and directing the refrigerant/oil mixture flowing out of the oil return heat exchanger to a compressor of the HVAC system. The oil return heat exchanger may be configured to exchange heat between the superheat refrigerant vapor and the refrigerant/oil mixture in the oil return heat exchanger. In some embodiments, the method of managing oil return to the compressor in a HVAC system can include preventing the superheat refrigerant vapor flowing into the first side of the oil return heat exchanger when the HVAC system is operated at a full load condition or relatively high saturated evaporator temperature.

Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

A compressor of a HVAC system may be lubricated with oil. In some HVAC systems, such as may include a chiller system, the oil of the compressor may circulate with the refrigerant in the refrigeration circuit, which is typically formed by the compressor, a condenser, an evaporator and an expansion device. Managing oil return to the compressor in the refrigeration circuit may be important to keep a proper oil level in the compressor to, for example, lubricate moving parts of the compressor. If the oil level in the compressor is too low, the compressor may be damaged due to lack of lubrication. Improvements can be made to help manage oil return to the compressor so that the oil level in the compressor can be kept at the proper level.

The embodiments as disclosed herein relate to methods, systems, and apparatuses that help manage oil return in, for example, a chiller. The chiller may include a condenser and an evaporator. In some embodiments, a refrigerant/oil mixture can be directed out of the evaporator into an oil return heat exchanger that is configured to help vaporize a refrigerant portion of the refrigerant/oil mixture. In some embodiments, superheat refrigerant vapor from the condenser can be directed into the oil return heat exchanger so that the heat energy of the superheat refrigerant vapor can be used to vaporize the refrigerant portion in the refrigerant/oil mixture. In some embodiments, the oil return heat exchanger can be physically positioned lower than the evaporator so that gravity can help the refrigerant/oil mixture to flow into the oil return heat exchanger. The embodiments as disclosed herein can help vaporize the refrigerant portion in the refrigerant/oil mixture so that an oil portion in the refrigerant/oil mixture can be entrained in the vaporized refrigerant portion and directed, for example, to the compressor by using for example suction of the compressor. In some embodiments, the refrigerant portion may be largely vaporized and the oil portion may be directed to the compressor as oil droplets entrained in the vaporized refrigerant. The embodiments as disclosed herein may also help increase heat transfer efficiency of the evaporator, and or the capacity/efficiency of the compressor.

References are made to the accompanying drawings that form a part hereof, and in which is shown by way of illustration of the embodiments in which the embodiments may be practiced. It is to be understood that the terms used herein are for the purpose of describing the figures and embodiments and should not be regarded as limiting the scope of the present application.

Figure 1:
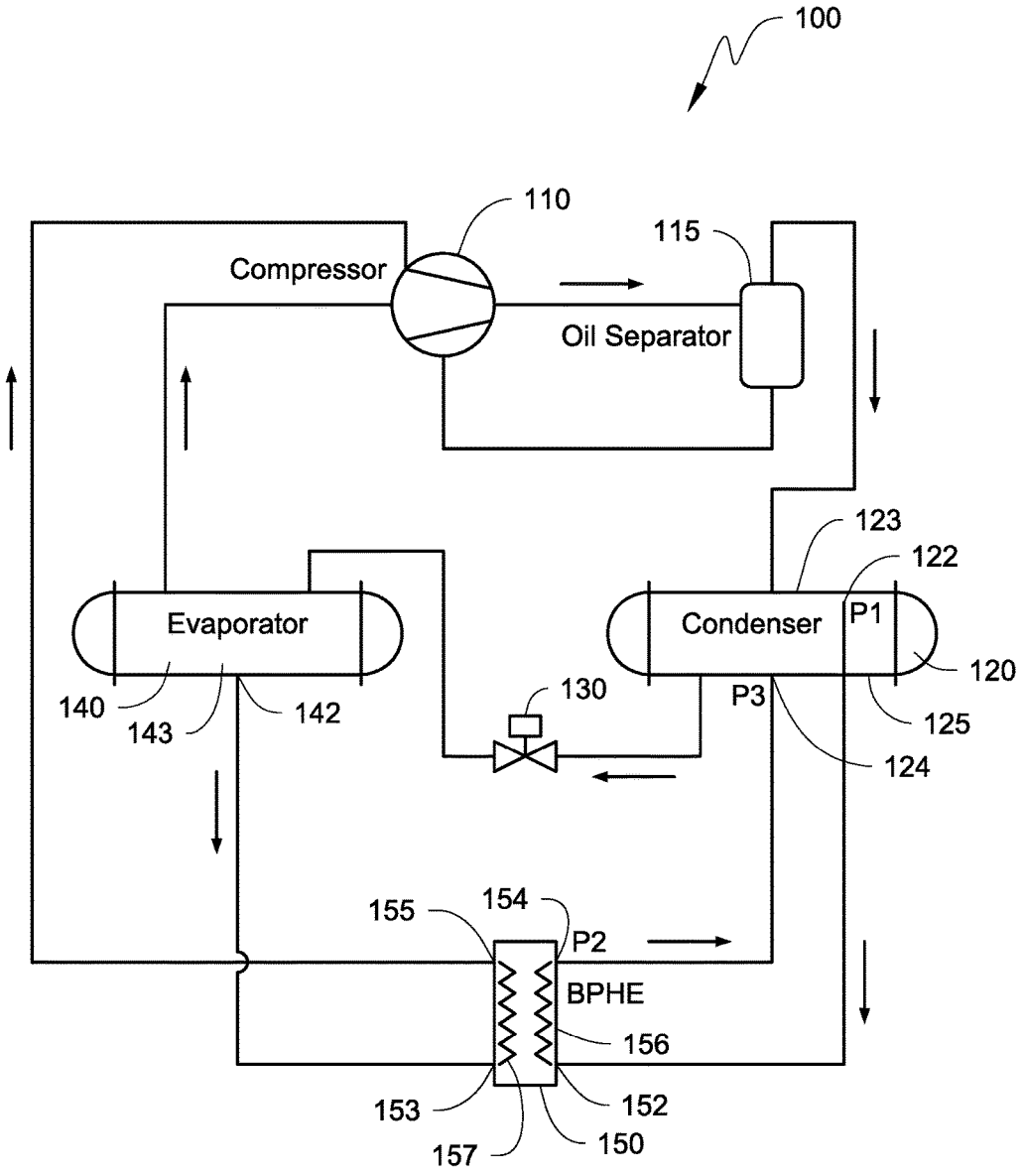
FIG. 1 illustrates a schematic diagram of a HVAC system including an oil return heat exchanger, according to one embodiment.

FIG. 1 illustrates a HVAC system 100 that includes a compressor 110, a condenser 120, an expansion device 130 and an evaporator 140, forming a refrigeration circuit. Refrigerant can be compressed by the compressor 110 and condensed into liquid refrigerant in the condenser 120. The liquid refrigerant can be expanded by the expansion device 130 then be directed into the evaporator 140 to exchange heat with a process fluid (e.g. air or water). The process fluid can then be used for other applications, such as for example cooling a space of a building. The refrigerant can then return to the compressor 110 to be compressed. The HVAC system 100 may include other components, such as an oil separator 115, unit controller (not shown) and other components as may be typically employed in a chiller.

Oil that lubricates the compressor 110 can be circulated in the refrigerant circuit with the refrigerant. Oil typically has a higher saturation temperature than the refrigerant and typically is in a liquid state when being circulated in the refrigerant circuit with the refrigerant. The evaporator 140, which may be a falling film type or a flooded type evaporator may tend to collect a relatively large amount oil inside the evaporator 140 under certain conditions.

In a falling film type of evaporator, the refrigerant can be vaporized in the evaporator 140. An oil portion, which may be circulated along with the refrigerant, generally is not vaporized. The oil portion may therefore accumulate inside the evaporator 140. In a flooded type of evaporator, the evaporator 140 may include a relatively large amount of oil/refrigerant mixture to submerge heat exchange tubes (not shown) in the evaporator 140. Managing oil return in these types of evaporators may be important for maintaining a proper oil level in the compressor 110 for proper lubrication of the compressor 110. If the oil is collected in the evaporator 140 and does not return to the compressor 110, the oil level in the compressor 110 may get low, causing damages to the compressor 110. The oil collected in the evaporator 140 may also decrease heat exchange efficiency of the evaporator 140.

To help oil collected in the evaporator 140 return to the compressor 110, the refrigerant/oil mixture in the evaporator 140 can be directed into an oil return heat exchanger 150. The oil return heat exchanger 150 is generally configured to have a condenser side 156 and an evaporator side 157. The condenser side 156 is generally configured to receive, for example, refrigerant from the condenser 120 as a heat source to exchange heat with a refrigerant/oil mixture received by the evaporator side 157 from the evaporator 140. As a result, a refrigerant portion of the refrigerant/oil mixture may be vaporized in the oil return heat exchanger 150.

The heat energy source of the oil return heat exchanger 150 can be superheat refrigerant vapor from the condenser 120. The superheat refrigerant vapor can be directed out of the condenser 120 from a condenser oil return heat exchanger outlet 122 into a condenser-side inlet 152 of the oil return heat exchanger 150. The superheat refrigerant vapor can exchange heat with the refrigerant/oil mixture directed out of an evaporator oil return heat exchanger outlet 142 of the evaporator 140 into an evaporator-side inlet 153 of the oil return heat exchanger 150. The superheat refrigerant vapor can help vaporize the refrigerant portion of the refrigerant/oil mixture inside the oil return heat exchanger 150.

The oil generally has a higher saturation temperature than the temperature of the superheat refrigerant vapor. As a result, the oil portion of the refrigerant/oil mixture can remain in the liquid state after flowing out of the oil return heat exchanger 150. In some embodiments, when the refrigerant/oil mixture flows out of an evaporator-side outlet 155 of the oil return heat exchanger 150, the refrigerant portion of the refrigerant/oil mixture can be largely vaporized and the remaining refrigerant/oil mixture can be largely an oil portion in the liquid state. In some embodiments, after flowing through the oil return heat exchanger 150, the refrigerant/oil mixture directed into the evaporator-side inlet 153 can mainly contain oil droplets at the evaporator-side outlet 155. The oil portion droplets can be entrained into the compressor 110 by the vaporized refrigerant portion. This may help oil return to the compressor 110.

In some embodiments, the evaporator oil return heat exchanger outlet 142 can be positioned at where an oil concentration in the evaporator 140 is relatively high. In a falling film evaporator, generally the lower portion of the evaporator 140 has a relatively high oil concentration. Accordingly, the evaporator oil return heat exchanger outlet 142 can be positioned on the lower portion of the evaporator 140. In a flooded evaporator, the liquid level position inside the evaporator 140 has a relatively high oil concentration. Accordingly, the evaporator oil return heat exchanger outlet 142 can be positioned at about the liquid level position in the evaporator 140.

In some embodiments, the oil return heat exchanger 150 can be physically positioned relatively lower than the evaporator 140, so that gravity can help drain the refrigerant/oil mixture from the evaporator oil return heat exchanger outlet 142 into the oil return heat exchanger 150.

In some embodiments, a density of the refrigerant/oil mixture at the evaporator-side outlet 155 is lower than the density of the refrigerant/oil mixture at the evaporator-side inlet 153, which can create a pressure differential between the inlet 153 and the outlet 155. The density/pressure differential of the refrigerant/oil mixture between the outlet 155 and the inlet 153 can help drive the refrigerant/oil mixture to flow from the inlet 153 toward the outlet 155. In some embodiments, the evaporator-side inlet 153 can be physically positioned lower than the evaporator-side outlet 155.

The condenser 120 includes an upper portion 123 and a lower portion 125. The upper portion 123 may generally contain superheat refrigerant vapor and the lower portion 125 may generally contain liquid refrigerant. The upper portion 123 has a pressure P1 that is higher than a pressure P3 of the lower portion 124. In some embodiments, the pressure differential between P1 and P3 is at or about 3 psi.

The condenser oil return heat exchanger outlet 122 can be generally positioned in the upper portion 123 of the condenser 120, and the condenser oil return heat exchanger inlet 124 can be generally positioned in the lower portion 125 of the condenser 120. The pressure differential between P1 and P3 can help drive superheat refrigerant vapor toward and pass through the oil return heat exchanger 150.

In the oil return heat exchanger 150, the superheat refrigerant vapor generally releases heat to the refrigerant/oil mixture from the evaporator 140. As a result, the superheat refrigerant vapor can be condensed into liquid refrigerant, which can be directed back to the condenser oil return heat exchanger inlet 124.

In some embodiments, the condenser-side inlet 152 of the oil return heat exchanger 150 can be physically positioned lower than the condenser-side outlet 154 of the oil return heat exchanger 150. In some embodiments, a pressure P2 at the condenser-side outlet 154 is generally smaller than the pressure P1. In some embodiments, a pressure differential between the pressure P1 and the pressure P2 is smaller than the pressure differential between the pressure P1 and the pressure P3. As a result, the refrigerant can be driven from the condenser oil return heat exchanger outlet 122 into the condenser-side inlet 152 of the oil return heat exchanger 150 as a superheat vapor, then be driven back to the condenser oil return heat exchanger inlet 124 from the condenser-side outlet 154 as refrigerant liquid by the pressure differential.

The oil return heat exchanger 150 can be a brazed-plate heat exchanger, with the understanding that other types of the heat exchanger can also be used. The brazed-plate heat exchanger can be relatively compact, which may help, for example, a retrofit application of an existing HVAC system with the oil return heat exchanger 150.

The heat exchanger capacity of the oil return heat exchanger 150 can be configured according to design specifications. In some embodiments, the heat exchanger capacity of the oil return heat exchanger 150 can be configured so that a designed specific oil circulation ration (OCR) (which is defined as the oil mass fraction in the compressor mass flow rate) can be achieved. In some embodiments, the OCR may be, for example, about 0.03%. In some embodiments, the heat exchanger capacity of the oil return heat exchanger 150 can be configured based on the OCR, a peak oil concentration (POC) (which is defined as the highest oil concentration in the refrigerant/oil mixture in the evaporator) in the evaporator 140 and a heat exchanger capacity of the evaporator 140. In some embodiments, the heat exchanger capacity of the oil return heat exchanger 150 may be configured relative to the heat exchange capacity of the evaporator. In some embodiments, the heat exchanger capacity of the oil return heat exchanger 150 can be configured at about: (OCR)/(POC)*(the heat exchanger capacity of the evaporator 140). In some embodiments, the heat exchanger capacity of the oil return heat exchanger 150 may be about 0.5% to 1% of the heat exchanger capacity of the evaporator 140.

The compressor 110 for the HVAC system 100 can be a screw compressor, a centrifugal compressor or other suitable compressors. These types of compressors may require oil for lubrication, and can generally benefit from the embodiments as disclosed herein. The screw compressor may require a relatively large amount of oil for lubrication, therefore the screw compressor may benefit from the embodiments as disclosed herein relatively more than other types of compressors.

The condenser 120 of the HVAC system 100 may be an air-cooled condenser or water-cooled condenser. In some embodiments, the condenser 120 can be a water-cooled shell-and-tube condenser.

Figure 2:
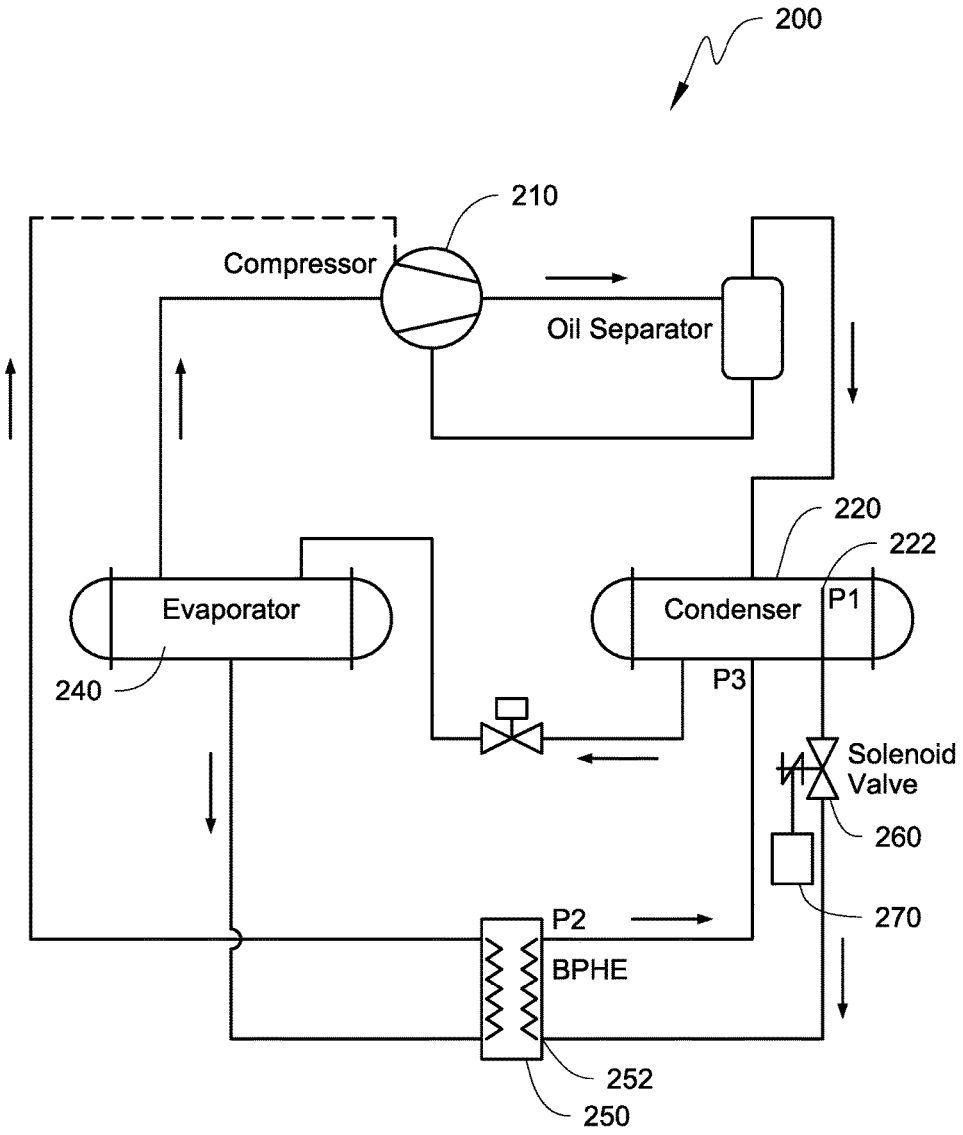
FIG. 2 illustrates a schematic diagram of a HVAC system including an oil return heat exchanger, according to another embodiment.

As illustrated in FIG. 2, in some embodiments, a solenoid valve 260 can be positioned between a condenser oil return heat exchanger outlet 222 and a condenser-side inlet 252 of an oil return heat exchanger 250 of a HVAC system 200. The solenoid valve 260 can be configured to have an "on" state that is configured to generally allow refrigerant vapor to flow from the condenser oil return heat exchanger outlet 222 to the condenser-side inlet 252, and an "off" state that is configured to generally prevent refrigerant flow between the condenser oil return heat exchanger outlet 222 and the condenser-side inlet 252. By regulating a period of time that the solenoid valve 260 stays in the "on" or "off" state, an amount of superheat refrigerant vapor directed to the oil return heat exchanger 250 can be regulated. By regulating the amount of superheat refrigerant vapor directed to the oil return heat exchanger 250, the amount of heat energy directed into the oil return heat exchanger 250 can be controlled. As a result, the refrigerant/oil mixture flow in the oil return heat exchanger 250 can also be regulated. The operation of the solenoid valve 260 can be controlled by a controller 270, with the understanding that the operation of the solenoid valve 260 can also be controlled manually or by other suitable controllers.

The solenoid valve 260 may help manage oil return in some operation conditions. For example, when the HVAC system 200 is operated with a relatively high load, such as at or about a full load condition or a relatively high saturated temperature in an evaporator 240, the OCR in the condenser 220 and/or the evaporator 240 can be relatively low and more oil can return from evaporator 240 to the compressor 210. In such a condition, the oil return to a compressor 210 may be sufficient to keep a proper oil level in the compressor 210, thus keep the compressor 210 properly lubricated without engaging the oil return heat exchanger 250. It may not be necessary to use the oil return heat exchanger 250 to help the oil return to the compressor 210. The controller 270 can obtain the load condition or the saturated temperature in the evaporator 240 from, for example, a unit controller of the HVAC system 200. When the controller 270 detects, for example, a full load condition, the controller 270 can set the solenoid valve 260 to the "off" state so as to generally prevent refrigerant flow between the condenser oil return heat exchanger outlet 222 and the condenser-side inlet 252.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. A HVAC system, comprising:

a condenser;

an evaporator;

a compressor; and an oil return heat exchanger;

wherein the oil return heat exchanger has an evaporator side configured to receive an refrigerant/oil mixture from the evaporator and a condenser side configured to receive superheat refrigerant vapor from the condenser, and the evaporator side and the condenser side are configured to exchange heat in the oil return heat exchanger, and wherein the condenser has a condenser oil return heat exchanger outlet and the oil return heat exchanger has a condenser-side inlet, and a valve positioned between the condenser oil return heat exchanger outlet and the condenser-side inlet of the oil return heat exchanger.

2. The HVAC system of claim 1, wherein the refrigerant/oil mixture from the evaporator side is directed to the compressor after flowing out of the oil return heat exchanger.

3. The HVAC system of claim 1, wherein the superheat refrigerant vapor from the condenser is directed to the condenser after flowing out of the oil return heat exchanger.

4. The HVAC system of claim 1, wherein the oil return heat exchanger is physically positioned lower than the evaporator.

5. The HVAC system of claim 1, wherein the evaporator side of the oil return heat exchanger has an evaporator-side inlet and an evaporator-side outlet, the evaporator-side inlet is configured to receive the refrigerant/oil mixture from the evaporator, the evaporator-side outlet is configured to direct the refrigerant/oil mixture to the compressor, the evaporator-side outlet is positioned physically higher than the evaporator-side inlet.

6. The HVAC system of claim 1, wherein the condenser side of the oil return heat exchanger has a condenser-side outlet, the condenser-side inlet is configured to receive the refrigerant from the condenser, the condenser-side outlet is configured to direct the refrigerant to the condenser, the condenser-side outlet is positioned higher than the condenser-side inlet.

7. The HVAC system of claim 1, wherein the condenser has a condenser oil return heat exchanger inlet, the condenser oil return heat exchanger outlet is configured to direct the refrigerant to the oil return heat exchanger, and the condenser oil return heat exchanger inlet is configured to receive the refrigerant from the oil return heat exchanger, the condenser oil return heat exchanger outlet is positioned physically higher than the condenser oil return heat exchanger inlet.

8. The HVAC system of claim 1, wherein the oil return heat exchanger is a brazed-plate heat exchanger.

9. The HVAC system of claim 1, wherein the compressor is a screw compressor.

10. The HVAC system of claim 1, wherein the valve includes an on state in which refrigerant vapor flow is enabled and an off state in which refrigerant flow is disabled.

11. The HVAC system of claim 10, wherein the valve is configured to be selectively alternated between the on state and the off state to regulate an amount of superheat refrigerant vapor directed to the oil return heat exchanger.

* * * * *